US005786570A

United States Patent [19]

Miya et al.

[11] Patent Number: 5,786,570

[45] Date of Patent: Jul. 28, 1998

[54] HEATING ROLLER DEVICE

[75] Inventors: Yukio Miya, Kawagoe; Osamu Sugiyama, Hanno; Ryota Koike, Tokorozawa; Takashi Toida; Yuji Fukazawa, both of Tokyo, all of Japan

[73] Assignee: Citizen Watch Co., Ltd., Tokyo, Japan

[21] Appl. No.: 785,220

[22] Filed: Jan. 17, 1997

[30] Foreign Application Priority Data

Jan. 19, 1996 [JP] Japan ..... 8-006936
May 13, 1996 [JP] Japan ..... 8-117505

[51] Int. Cl.[6] ..... G03G 15/20

[52] U.S. Cl. ..... 219/469; 432/60

[58] Field of Search ..... 219/469, 470; 432/60, 228; 492/46; 399/330–334

[56] References Cited

U.S. PATENT DOCUMENTS 5,125,644 6/1992 Masaki et al. ..... 271/308

FOREIGN PATENT DOCUMENTS 2-33344 2/1990 Japan .
6-348154 12/1994 Japan .
7-270891 5/1995 Japan .
7-295409 11/1995 Japan .

OTHER PUBLICATIONS

Patent Abstract: "Surface Coated Structural Material," JP 02–129366, May 1990.

Patent Abstract: "Carbon Fibre Carbon Composite Structural Material," JP 02–297430, Dec. 1990.

Patent Abstract: "Surface Coated Carbon Roll," JP 05–345930, Dec. 1993.

*Primary Examiner*—Teresa J. Walberg
*Assistant Examiner*—J. Pelham
*Attorney, Agent, or Firm*—Armstrong, Westerman, Hattori, McLeland & Naughton

[57] ABSTRACT

A heating roller device including a center shaft, a heat roller rotatably supported on the center shaft, and heating means provided inside the heat roller has the wear resistance of the outer surface of its heat roller outer surface increased and its availability factor enhanced by forming the outer surface of the heat roller with a hard carbon film of hydrogenated amorphous carbon. The hard carbon film is preferably formed on an intermediate layer formed on the outer surface of the heat roller beforehand so and to increase its adhesion to the outer surface. Wear resistance can be further enhanced by forming the outer surface of the heat roller with a hard layer, forming an intermediate layer on the hard layer and forming the hard carbon film on the intermediate layer.

5 Claims, 4 Drawing Sheets

HEATING ROLLER DEVICE

BACKGROUND OF THE INVENTION

1. Field of the Invention

This invention relates to a heating roller device used for drawing filament, film or the like in a heated state.

2. Description of the Related Art

A heating roller device is used for drawing filament, film or the like in a heated state. One such prior-art heating roller device is taught, for example, by Japanese Patent Laid-Open Publication No. 2-33,344.

This heating roller device has a center shaft, a heat roller rotatably supported by the center shaft, and heating means provided inward of the heat roller. The heat roller is formed as a cylinder of chromium-molybdenum steel whose outer surface is coated with a hard chromium film formed by hard chromium plating.

When the heating roller device of this type is used to draw filament, film or the like in a heated state under tension, the surface of its heat roller is worn by sliding contact with the filament, film or the like. The outer surface of the conventional heat roller is therefore formed with the hard chromium film having a Vickers hardness of about 1,000.

Since the heat roller is rotated at high speed, however, wearing of its surface cannot be prevented even by formation of the hard chromium film.

As the surface of the heat roller wears during use of the heating roller device, the sectional shape of the heat roller becomes indented. When thread formed by twisting together multiple filaments is drawn using the indented roller, some of the filaments break. With further wear, the corners of the indented portion become sharp and thread breakage occurs. On the other hand, when film is drawn, it incurs surface scratching and breakage.

Therefore, when the heat roller becomes worn, the heating roller device is shut down and the worn heat roller is replaced with a new one.

Roller replacement not only is troublesome but also lowers the availability factor of the heating roller device and delays the progress of the filament or film drawing work.

SUMMARY OF THE INVENTION

This invention is directed to overcoming the aforesaid problems of the prior-art heating roller device and has as its object to improve the wear resistance of the outer surface of the heat roller dramatically, thereby greatly prolonging the period for which the heating roller device can be operated without heat roller replacement and thus markedly enhancing the availability factor of the heating roller device.

The invention achieves this object by providing a heating roller device whose heat roller is formed on its outer surface with a hard carbon film of hydrogenated amorphous carbon.

The adhesion of the hard carbon film to the outer surface is preferably increased by forming the hard carbon film on an intermediate layer formed on the outer surface of the heat roller beforehand.

The intermediate layer is preferably formed as a two-layer film consisting of a metal film and a film of an element of group IVb of the periodic table of elements or as a film of an alloy of a metal and a group IVb element.

It is also possible to form the intermediate layer of the heat roller of a first intermediate layer formed directly on the outer surface of the heat roller and a second intermediate layer formed on the first intermediate layer and to form the hard carbon film on the second intermediate layer. In this case, the first intermediate layer is preferably formed of titanium (Ti) or chromium (Cr) and the second intermediate layer is preferably formed of silicon carbide (SiC) or tungsten carbide (WC).

It is further possible to form a hard layer on the outer surface of the heat roller of the heating roller device, form an adhesion-enhancing intermediate layer on the hard layer and form a hard carbon film of hydrogenated amorphous carbon on the intermediate layer.

In this case, also, the intermediate layer preferably comprises a first intermediate layer formed of titanium (Ti) or chromium (Cr) and a second intermediate layer formed of silicon carbide (SiC) or tungsten carbide (WC).

The hard layer of the heat roller is a hard chromium film formed by hard chromium plating or a carburized layer or quench-hardened layer of the heat roller substrate material.

In the heating roller device of this invention, the hard carbon film of hydrogenated amorphous carbon formed on the outer surface of the heat roller is a black DLC (diamond-like carbon) film with properties similar to diamond.

Specifically, the hard carbon film has high mechanical hardness (Vickers hardness of 4,000) and a low coefficient of friction of about 0.1, which is between 1/5 and 1/10 that of the hard chromium film formed on the outer surface of prior-art heat rollers. Since it has a surface roughness of not greater than 1 nm, moreover, it is excellent in surface smoothness.

The hard carbon film formed on the outer surface of the heat roller of the invention heating roller device therefore imparts the heat roller with extremely high wear resistance. As a result, the service life of the heat roller can be extended to ten or more times that of a conventional heat roller formed with a hard chromium film.

The wear resistance of the heat roller is even further enhanced when an intermediate layer of one of the aforesaid types is formed on the outer surface of the heat roller beforehand and the hard carbon film is formed on the intermediate layer. This is because the presence of the intermediate layer additionally increases the adhesive force of the hard carbon film to the surface of the heat roller.

A heat roller with excellent alkali resistance can be obtained by forming the intermediate layer in a two-layer structure comprising a second layer of silicon carbide or tungsten carbide lying immediately under the hard carbon film.

Alkali resistance is desirable because an alkali solution is used to etch and remove oil, filament scraps, fiber reinforcing agent and the like that stick to the surface of the hard carbon film formed on the surface of the heat roller of the heating roller device. Since the second intermediate layer resists etching even if alkali solution should reach it through pinholes which very rarely form in the hard carbon film, the hard carbon film is safe from degradation by peeling and the like.

On the other hand, the first intermediate layer of titanium or chromium formed directly on the surface of the heat roller works to strengthen the adhesion to the heat roller substrate (chromium-molybdenum steel).

In addition, wear tests show that when a hard layer is formed under the intermediate layer so that a hard layer-intermediate layer-hard carbon film structure is formed on the outer surface of the heat roller, the durability of the hard carbon film is improved over that in the case where no hard layer is formed.

The above and other objects, features and advantages of the invention will be apparent from the following detailed description which is to be read in conjunction with the accompanying drawings.

DETAILED DESCRIPTION OF THE PREFERRED EMBODIMENTS

Embodiments of the invention will now be explained with reference to the drawings.

The structure of the heating roller device to which the invention applies will first be explained with reference to FIG. 1.

Figure 1:
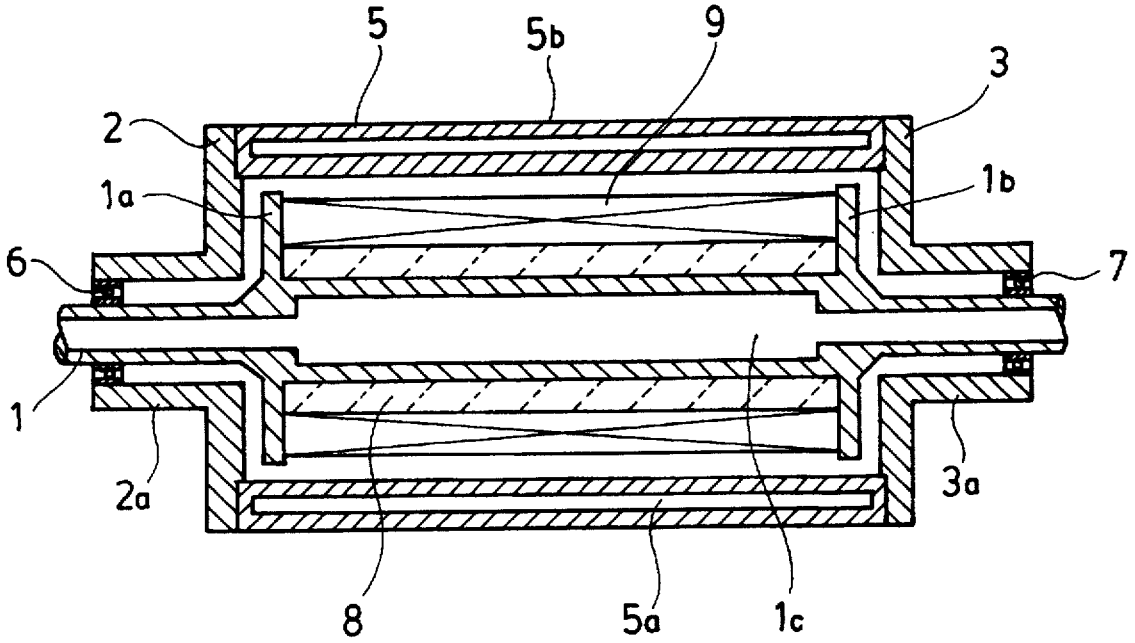
FIG. 1 is an axial sectional view showing the structure of a heating roller device that is an embodiment of the invention.

As shown in FIG. 1, the heating roller device comprises a cylindrical heat roller 5 supported on the periphery of a hollow center shaft 1 via a pair of flanges 2, 3. The flanges 2, 3 are shaped like disks and are integrally formed with symmetrically disposed cylindrical portions 2*a*, 3*a* of an inner diameter greater than the outer diameter of the center shaft 1. Bearings 6, 7 are provided between the cylindrical portions 2*a*, 3*a* and the center shaft 1 to enable the heat roller 5 to rotate freely about the center shaft 1.

The heat roller 5 and the flanges 2, 3 are fixed to each other by screws or other such fastening means (not shown). One of the flanges 2, 3 is rotated by a rotating mechanism driven by a motor (not shown) so as to rotate the heat roller 5 about the center shaft 1. A gear or pulley is attached to the flange 2 or 3 for this purpose but is not shown in the drawing.

The center shaft 1 is formed with a pair of flanges 1*a*, 1*b*, an iron core 8 is fitted between the flanges 1*a*, 1*b* as a magnetic material and a coil 9 is wound on the iron core 8. Although not shown in FIG. 1, the terminals of the coil 9 are led to the outside through a hollow portion 1*c* of the center shaft 1 and supplied with a low-frequency alternating voltage.

The application of the alternating voltage to the coil 9 produces an alternating magnetic flux which induces a shorted current in the circumferential direction of the inner wall of the heat roller 5. The heat roller 5 is thus inductively heated by Joule heat.

The cylindrical heat roller 5 is formed with a jacketed chamber 5*a* and a two-phase (gas-liquid) heat transfer medium (e.g., naphthalene) is sealed therein.

The heat transfer medium sealed in the jacketed chamber 5*a* is evaporated by the heat generated by the heat roller 5. When the resulting vapor comes in contact with the inner wall of the jacketed chamber 5*a* at a surface portion of the heat roller 5 where the temperature is low, it condenses. The inner wall of the jacketed chamber 5*a* at the low-temperature surface portion is heated by the resulting latent heat.

When the condensed heat transfer medium comes in contact with the inner wall of the jacketed chamber 5*a* at a surface portion of the heat roller 5 where the temperature is high, it is evaporated by the heat at this portion. In this manner, the heat transfer medium repeatedly absorbs heat by evaporation and releases latent heat by condensation, thereby maintaining the surface of the heat roller 5 at a uniform temperature.

In this heating roller device, therefore, the iron core 8, coil 9 and heat transfer medium inside the jacketed chamber 5*a* constitute heating means with temperature control function.

Examples of the coating film formed on the outer surface of the heat roller 5 of the heating roller device of this heating roller device will next be explained with reference to FIGS. 2 to 5.

Figure 2:
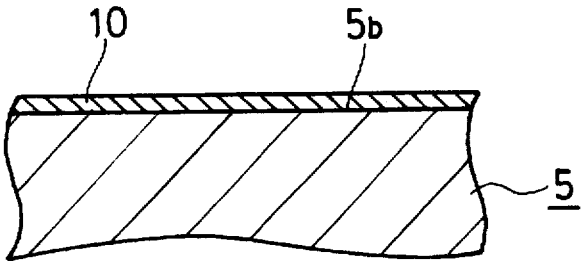
FIGS. 2, 3, 4 and 5 are enlarged sectional views each showing a portion in the vicinity of the outer surface of a heat roller of a heating roller device that is a different embodiment of the invention.

FIG. 2 is an enlarged sectional view of a portion in the vicinity of the outer surface 5*b* of a first embodiment of the heat roller 5 of the heating roller device of FIG. 1.

The heat roller 5 is made of chromium-molybdenum steel and its outer surface 5*b* is formed with a hard carbon film 10 of hydrogenated amorphous carbon. While the thickness of the hard carbon film 10 can be varied depending on purpose of use, it is generally of a uniform thickness in the range of 1 μm to 5 μm.

The hard carbon film 10 has an amorphous structure including hydrogen and is black in color. It is very similar in properties to diamond. Specifically, it has high mechanical hardness (Vickers hardness of 4,000) and a very low coefficient of friction of 0.1. Since its surface roughness is 1 nm or less, moreover, it is excellent in surface smoothness.

The hard carbon film 10 formed on the outer surface of the heat roller 5 therefore imparts the heat roller 5 with outstanding wear resistance. As a result, the service life of the heat roller 5 is ten or more times that of a conventional heat roller formed on its outer surface with a hard chromium film.

Figure 3:
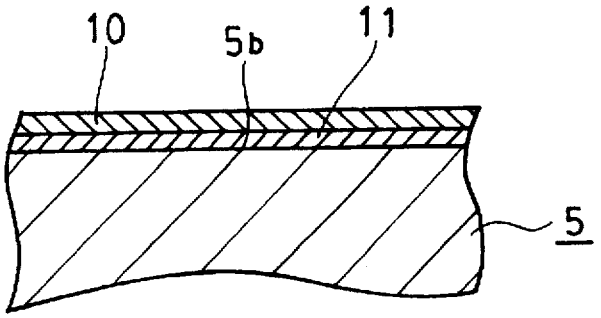

A second embodiment of the heat roller of the heating roller device of this invention will now be explained with reference to FIG. 3, which is a sectional view similar to FIG. 2.

In the heat roller 5 of this second embodiment, the hard carbon film 10 is formed on an intermediate layer 11 formed on the outer surface 5*b* for enhancing the adhesion between the hard carbon film 10 and the outer surface 5*b*. The intermediate layer 11 provided under the hard carbon film 10 is a film of an alloy of a metal and an element of group IVb in the periodic table of elements or a two-layer film (laminated films) consisting of a metal film and a film of a group IVb element.

Specific materials usable for the intermediate layer 11 include titanium, chromium, aluminum, tantalum, molybdenum and tungsten as the metal, and silicon, germanium and carbon as the group IVb element.

When constituted of a metal film, the intermediate layer 11 is formed to a thickness of about 0.5 μm. When constituted of laminated films, each film is formed to a thickness of about 0.5 μm, giving the intermediate layer 11 an overall thickness of around 1.0 μm.

Since the hard carbon film 10 of the heat roller 5 of this second embodiment is formed via the intermediate layer 11, the adhesion between the hard carbon film 10 and the substrate (chromium-molybdenum steel) of the heat roller 5 is increased by the intermediate layer 11.

When the intermediate layer 11 is formed as a two-layer film consisting of a metal film and a film of a group IVb element, the lower metal film works to increase adhesive force relative to the outer surface of the heat roller 5, and the group IVb works to increase adhesive force by covalent binding with the hard carbon film 10.

Since the embodiment provided with the intermediate layer 11 therefore enjoys stronger adhesive force between the hard carbon film 10 and the heat roller 5, the wear resistance of the heat roller 5 is enhanced and the availability factor of the heating roller device increased.

Figure 4:
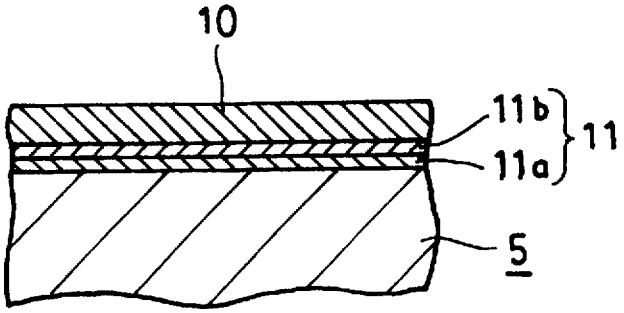

A third embodiment of the heat roller of the heating roller device of this invention will now be explained with reference to FIG. 4, which is a sectional view similar to FIG. 2.

The heat roller 5 of this third embodiment has an intermediate layer 11 consisting of a first (lower) intermediate layer 11*a* and a second (upper) intermediate layer lib formed on the outer surface thereof and the hard carbon film 10 is formed on the intermediate layer 11.

The first intermediate layer 11*a* is formed as a titanium (Ti) or chromium (Cr) film and the second intermediate layer 11*b* is formed of silicon carbide (SiC) or tungsten carbide (WC).

The titanium or chromium film constituting the first intermediate layer 11*a* works to heighten the adhesion to the chromium-molybdenum steel that is the substrate of the heat roller 5. Further, the silicon carbide or tungsten carbide of the second intermediate layer 11*b* is excellent in alkali resistance. Therefore, when an alkali solution is used to etch and remove adhering matter (such as oil, filament scraps and/or fiber reinforcing agent in sludge or carbonized form) that sticks to the surface of the hard carbon film 10 formed on the heat roller 5, the second intermediate layer 11*b* is safe from etching even if alkali solution should find its way through the hard carbon film 10. As a result, peeling of the hard carbon film 10 is prevented.

The alkali solution used is a sodium hydroxide (NaOH) solution. Specifically, a sodium hydroxide solution prepared to have strong alkalinity (a pH in the range of 11–13) is used as an agent for removing matter that sticks to the surface of the heat roller 5. Such matter includes oil, filament scraps and/or fiber reinforcing agent in sludge or carbonized form. The process of removing it by use of the sodium hydroxide solution consists of scrubbing the surface of the heat roller 5 with waste cotton impregnated with the sodium hydroxide solution or soaking the heat roller 5 in the sodium hydroxide solution to remove the adhering matter from its surface by etching.

Although formation of pinholes in the hard carbon film 10 is very rare, even if one or more should form and alkali solution should pass therethrough to the second intermediate layer 11*b* formed under the hard carbon film 10, the second intermediate layer 11*b* will not be etched because it is highly resistant to the alkali solution. The hard carbon film 10 is therefore safe from degradation by peeling or the like.

The first intermediate layer 11*a* consisting of a titanium or chromium film is formed to a thickness of about 0.5 μm and the second intermediate layer 11*b* consisting of silicon carbide or tungsten carbide is also formed to a thickness of about 0.5 μm.

Figure 5:
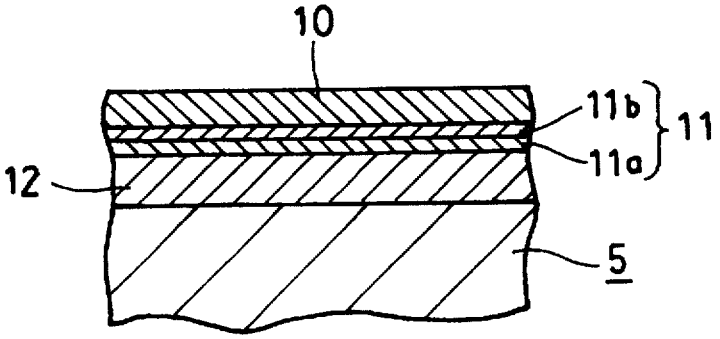

A fourth embodiment of the heat roller of the heating roller device of this invention will now be explained with reference to FIG. 5, which is a sectional view similar to FIG. 2.

The outer surface of the heat roller 5 of this fourth embodiment is formed with a hard layer 12, an intermediate layer 11 consisting of a first (lower) intermediate layer 11*a* and a second (upper) intermediate layer 11*b* is formed on the hard layer 12 and the hard carbon film 10 is formed on the intermediate layer 11.

The hard layer 12 is a hard chromium film, a carburized layer or a quench-hardened layer. A hard chromium film used for the hard layer 12 is formed to a thickness in the approximate range of 10 μm to 30 μm and a carburized layer used therefor is formed to a thickness in the approximate range of 0.1 mm to 1.0 mm. While a quench-hardened layer used therefor need be formed only on the outer surface of the heat roller 5, it is also possible to form the entire heat roller 5 with a quench-hardened layer so as to increase the hardness thereof.

When the hard layer 12 is formed as a hard chromium film it is formed to the aforesaid thickness by subjecting the surface of the heat roller 5 to hard chromium plating using the electrolytic plating method. When the hard layer 12 is formed as a carburized layer in the vicinity of the outer surface of the heat roller 5, the carburization is conducted under the following conditions in a mixed gas atmosphere of a carbonaceous gas, such as methane ($CH_4$) or ethylene ($C_2H_4$), and nitrogen ($N_2$) as a carrier gas.

| Carburizing Conditions: | |
|---|---|
| Temperature | 1,100° C. |
| Time | 30 min |
| Carburization depth | 0.5 mm |

The substrate of the heat roller 5 formed with the hard layer 12 in this example is the chromium-molybdenum steel designated as type SCM 420 under the Japanese Industrial Standards (JIS).

When the hard layer 12 is formed as a quench-hardened layer, the chromium-molybdenum steel designated by JIS as type SCM 435 or SCM 440 is used as the substrate of the heat roller 5. The quench-hardening conditions differ depending on whether a quench-hardened layer is formed only at the outer surface of the heat roller 5 or the entire heat roller 5 is formed with the quench-hardened layer. The optimum treatment conditions are selected for each case. The quench-hardening is followed by tempering.

To give a concrete example, the heat roller 5 is quench-hardened by heating to 830°–880° C. followed by quenching in oil, whereafter it is tempered by heating to 530°–630° C. followed by rapid cooling. The outer surface of the heat roller 5 is then polished if necessary.

As in the third embodiment, the first intermediate layer 11*a* is a titanium or chromium film formed to a thickness of about 0.5 μm and the second intermediate layer 11*b* is formed of silicon carbide (SiC) or tungsten carbide (WC), also to a thickness of about 0.5 μm.

This fourth embodiment differs from the third embodiment only in the point that the hard layer 12 is formed under the first intermediate layer 11*a*. Specifically, in this fourth embodiment the outer surface of the heat roller is clad with a hard layer-intermediate layer-hard carbon film structure. Wear tests show that adopting this structure approximately doubles the durability of the hard carbon film 10 relative to the case where the hard layer 12 is not formed and also approximately doubles the service life of the heat roller. The reason is not known.

In the heating roller device shown in FIG. 1, the heating means with temperature control function comprises the iron core 8, the coil 9 for generating Joule heat and the heat transfer medium inside the jacketed chamber 5*a* of the heat roller 5 for transferring the generated heat by repeated evaporation and condensation. The invention is not limited to this arrangement, however, and the heating means with temperature control function can instead be heating means using a heating wire or heating means which introduces a temperature-controlled liquid into the heat roller 5.

Moreover, while the heat roller was described as being of cylindrical shape, the external and internal configurations of the heat roller can be modified in line with the purpose of use.

In the heating roller device shown in FIG. 1, the heat roller 5 is supported to be rotatable around the center shaft 1. The invention is not limited to this arrangement, however, and it is instead possible to fix the heat roller 5 to the center shaft 1 and to rotate the center shaft 1 with a motor so as to rotate the heat roller 5 integrally therewith.

The thickness of the hard carbon film formed on the surface of the heat roller is not restricted to the range of 1 μm to 5 μm of the embodiments set out in the foregoing but can be increased in cases where the heat roller is required to have high wear resistance or be reduced in cases where the heat roller is not required to have such high wear resistance. In other words, the thickness of the hard carbon film formed on the surface of the heat roller can be adjusted according to the purpose of use.

Film-forming methods for forming the hard carbon film and the intermediate layer or layers on the outer surface of the heat roller of the heating roller device of this invention will now be explained with reference to FIGS. 6 to 9.

Figure 7:
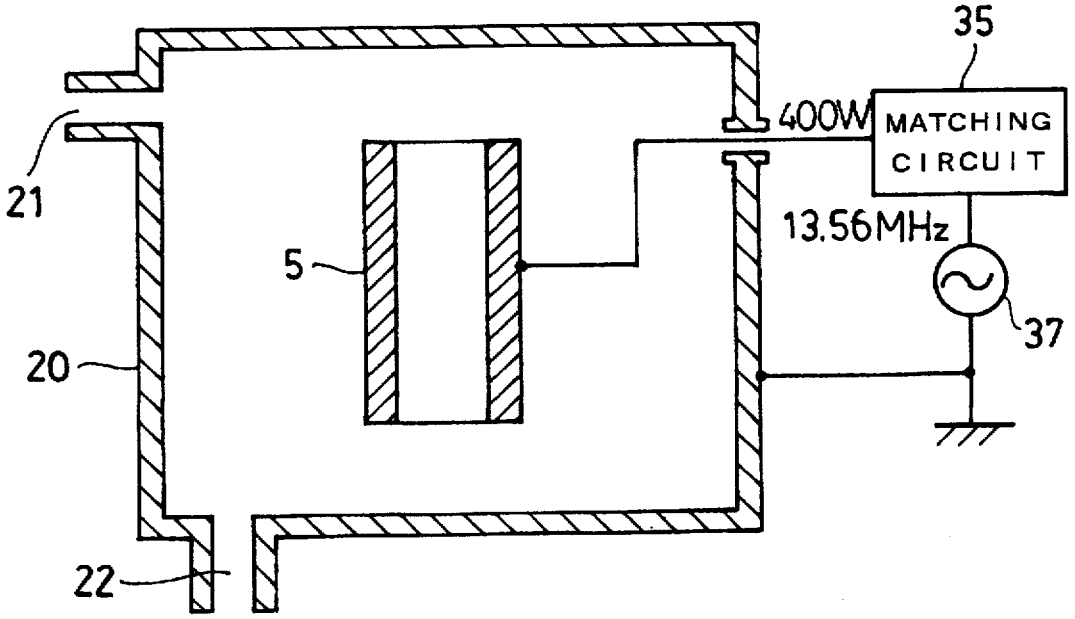
Figure 8:
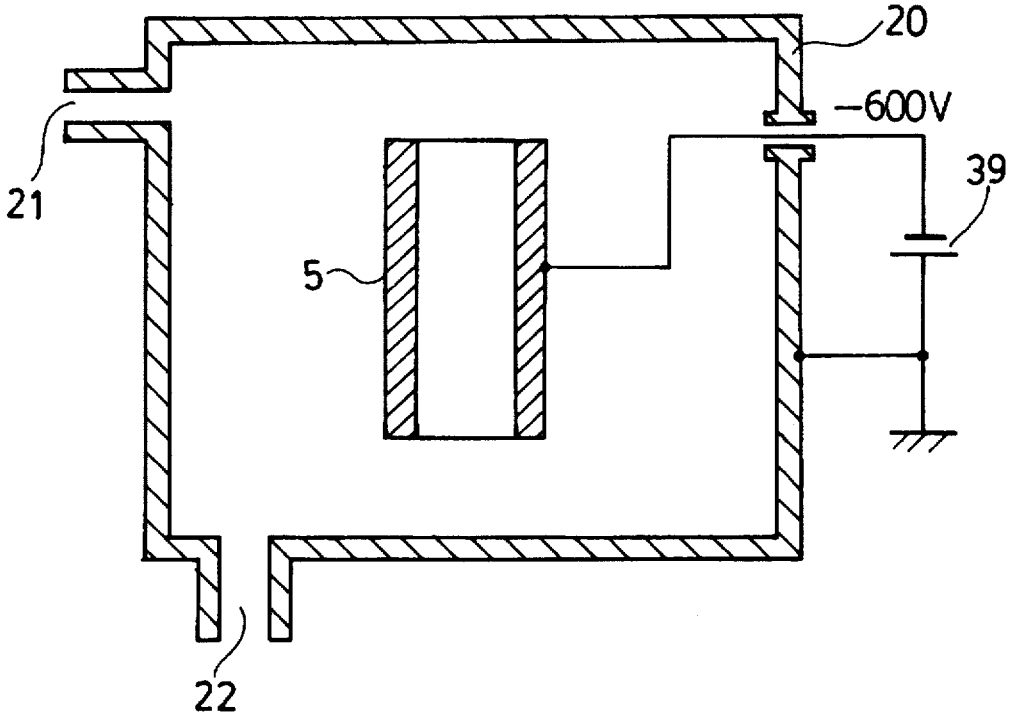

Methods of forming the hard carbon film will be explained first with reference to FIGS. 6 to 8.

Figure 6:
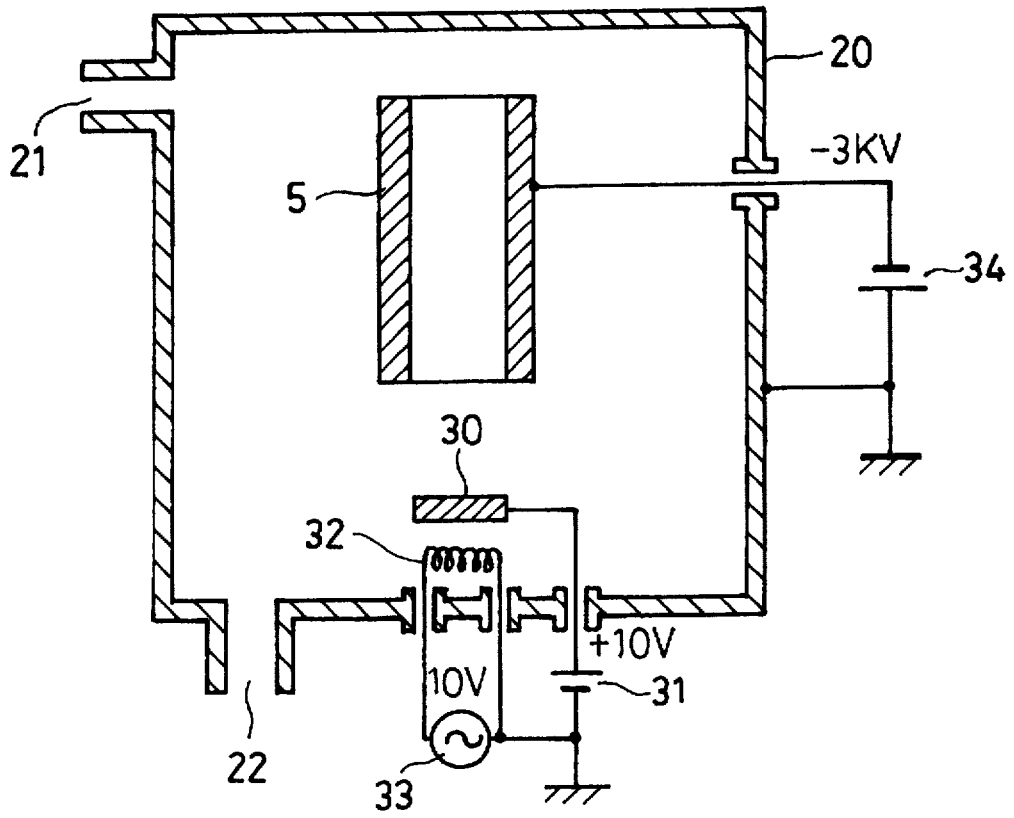
FIGS. 6, 7 and 8 are schematic sectional views of apparatuses for explaining different methods of forming a hard carbon film on the outer surface of a heat roller of a heating roller device according to the invention.

FIG. 6 shows a film-forming apparatus used to form the hard carbon film. In the method employing this apparatus, a heat roller 5 made of chromium-molybdenum steel is placed in a vacuum vessel 20 equipped with a gas inlet port 21 and an evacuation port 22. The heat roller 5 is supported in the vacuum vessel 20 by a member not shown in the drawing. An anode 30 and a filament 32 are provided in the vacuum vessel 20.

A vacuum pump or other such evacuation means (not shown) is used to vacuumize the vacuum vessel 20 via the evacuation port 22 to a degree of vacuum of not less than $3\times10^{-5}$ torr.

Benzene gas ($C_6H_6$) is then supplied as a carbon-containing gas through the gas inlet port 21 into the vacuum vessel 20 so as to control the pressure in the vacuum vessel 20 within the range of $1\text{–}5\times10^{-3}$.

A DC voltage is applied to the anode 30 from an anode power source 31 and an AC voltage is applied to the filament 32 from a filament power source 33. The DC voltage applied to the filament 32 from the anode power source 31 at this time is a positive DC voltage of about 10 V. An AC voltage of 10 V is applied to the filament 32 from the filament power source 33 so as to produce a current of 30 A through the filament 32.

A negative DC voltage of −3 kV is applied to the heat roller 5 from a DC power source 34. Thus a plasma is produced in the region surrounding the heat roller 5 within the vacuum vessel 20, whereby a hard carbon film is formed on the surface of the heat roller 5. The hard carbon film is formed to a thickness in the range of 1 μm to 5 μm. A hard carbon film of more uniform thickness can be formed if the heat roller 5 is rotated during film forming.

Another method of forming the hard carbon film will now be explained with reference to FIG. 7.

In this method, a heat roller 5 made of chromium-molybdenum steel is placed in a vacuum vessel 20 equipped with a gas inlet port 21 and an evacuation port 22.

A vacuum pump or other such evacuation means (not shown) is used to vacuumize the vacuum vessel 20 via the evacuation port 22 to a degree of vacuum of not less than $3\times10^{-5}$ torr.

Methane gas ($CH_4$) is then supplied as a carbon-containing gas through the gas inlet port 21 into the vacuum vessel 20 so as to adjust the degree of vacuum to 0.1 torr. Four hundred watts of high-frequency power from a high-frequency power source 37 with an oscillating frequency of 13.56 MHz is thereafter applied to the heat roller 5 through a matching circuit 35.

As a result, a plasma is produced in the region surrounding the heat roller 5, whereby a hard carbon film is formed on the surface of the heat roller 5 to a thickness in the range of 1 μm to 5 82 m. A hard carbon film of more uniform thickness can be formed if the heat roller is rotated during film forming.

Another method of forming the hard carbon film will now be explained with reference to FIG. 8. This method is conducted under the same conditions as in the example of FIG. 7 except that instead of applying high-frequency power to the heat roller 5 a negative DC voltage of −600 V is applied thereto from a DC power source 39. Under these conditions a plasma is also produced in the region surrounding the heat roller 5, whereby a hard carbon film is formed on the surface of the heat roller 5 to a thickness in the range of 1 μm to 5 μm.

In methods of forming a hard carbon film on the surface of the heat roller described in the foregoing, methane or benzene is used as the gas containing the carbon for formation of the hard carbon film. The invention is not limited to use of these gases, however, and it is possible instead to use ethylene ($C_2H_4$) or any of various other carbonaceous gases. Moreover, it is also possible to form a hard carbon film on the surface of the heat roller in the same manner as in the foregoing examples by using a mixed gas of a carbonaceous gas added with argon (Ar), helium (He) or hydrogen ($H_2$).

A method of forming the intermediate layer formed under the hard carbon film will now be explained with reference to FIG. 9.

Figure 9:
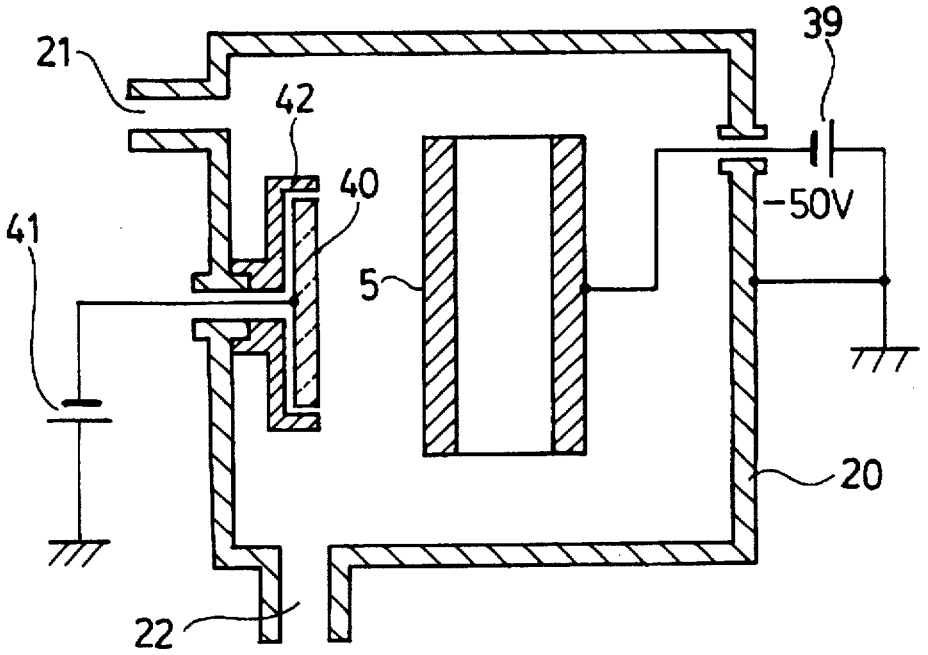
FIG. 9 is schematic sectional view of an apparatus for explaining a method of forming an intermediate layer on the outer surface of a heat roller of a heating roller device according to the invention.

FIG. 9 shows a film-forming apparatus used to form the intermediate layer. In the method employing this apparatus, a heat roller 5 to be formed with an intermediate layer is placed in a vacuum vessel 20*a* so as to be positioned opposite a target 40 composed of intermediate layer material and protected by a sputter cover 42.

The interior of the vacuum vessel 20 is then evacuated through the evacuation port 22 and argon gas (Ar) is introduced as sputter gas through the gas inlet port 21. Subsequently, a negative DC voltage is applied to the target 40 from a target power source 41, and a negative DC voltage of −50 V is applied to the heat roller 5 from a DC power source 39.

As a result, a plasma is produced inside the vacuum vessel 20 and ions in the plasma produced bombard the surface of the target 40 composed of intermediate layer material to produce sputtering. The intermediate layer material driven from the surface of the target 40 adheres to the surface of the heat roller 5 to form an intermediate layer thereon.

When the outer surface of the heat roller 5 is to be formed with a composite intermediate layer consisting of a first intermediate layer and a second intermediate layer, the individual layers can be formed by almost the same method. The only difference is that the material of the target 40 has to be changed between the formation of the two intermediate layers.

For instance, when the first intermediate layer is formed, titanium or chromium is used for the target 40, and when the second intermediate layer is formed, the material of the target 40 is changed to silicon carbide or tungsten carbide. When the second intermediate layer is formed of silicon carbide or tungsten carbide, the silicon to carbon ratio or the tungsten to carbon ratio in atomic percentage is set at 1 to 1.

The hard carbon film is formed on the single intermediate layer or on the upper one of the two intermediate layers. As the method of forming the hard carbon film on the upper surface of the intermediate layer is the same as that explained earlier with reference to FIGS. 6 and 8, it will not be explained further here.

The method of forming the intermediate layer is not limited to the sputtering method and it is instead possible to use any of various other physical vapor deposition (PVD) methods including vacuum deposition and ion plating.

Although the substrate of the heat roller 5 was described as being chromium-molybdenum steel in the foregoing embodiments, the substrate of the heat roller can be selected according to purpose of use from among stainless steel, KS steel and other metals or from among ceramics and other nonmetals.

When the heat roller is formed of an electrical insulator such as ceramic, the intermediate layer is formed of a metal material such as titanium or chromium by a PVD method not requiring application of a voltage and voltage is thereafter applied to the intermediate layer to form the hard carbon film by the plasma CVD method described above.

What is claimed is:

1. A heating roller device comprising:

a center shaft, a heat roller rotatably supported on the center shaft, heating means provided inside the heat roller, an outer surface of the heat roller being formed with a hard carbon film of hydrogenated amorphous carbon, and an intermediate layer formed between the outer surface of the heat roller and the hard carbon film for increasing adhesion of the hard carbon film to the outer surface, the intermediate layer comprises a first intermediate layer formed directly on the outer surface of the heat roller and a second intermediate layer formed on the first intermediate layer and the hard carbon film is formed on the second intermediate layer, the first intermediate layer being formed of titanium (Ti) or chromium (Cr) and the second intermediate layer being formed of silicon carbide (SiC) or tungsten carbide (WC).

2. A heating roller device comprising:

a center shaft, a heat roller rotatably supported on the center shaft, and heating means provided inside the heat roller, an outer surface of the heat roller being formed with a hard layer, an intermediate layer being formed on the hard layer and a hard carbon film of hydrogenated amorphous carbon being formed on the intermediate layer to have its adhesion increased by the intermediate layer, wherein the intermediate layer comprises a first intermediate layer formed directly on the hard layer and a second intermediate layer formed on the first intermediate layer and the hard carbon film is formed on the second intermediate layer, the first intermediate layer being formed of titanium (Ti) or chromium (Cr) and the second intermediate layer being formed of silicon carbide (SiC) or tungsten carbide (WC).

3. A heating roller device according to claim 2, wherein the hard layer is a hard chromium film formed by hard chromium plating.

4. A heating roller device according to claim 2, wherein the hard layer is a carburized layer.

5. A heating roller device wherein the claim 2, wherein the hard layer is a quench-hardened layer.

* * * * *